US011639065B2

(12) United States Patent
Hokazono

(10) Patent No.: US 11,639,065 B2
(45) Date of Patent: May 2, 2023

(54) IMAGE FORMATION APPARATUS AND HEATING METHOD FOR IMAGE FORMATION APPARATUS

(71) Applicant: Konica Minolta, Inc., Tokyo (JP)

(72) Inventor: Yutaka Hokazono, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 5 days.

(21) Appl. No.: 17/520,495

(22) Filed: Nov. 5, 2021

(65) Prior Publication Data

US 2022/0176716 A1 Jun. 9, 2022

(30) Foreign Application Priority Data

Dec. 3, 2020 (JP) ..... JP2020-201126

(51) Int. Cl.
*B41J 11/00* (2006.01)
*B41J 13/03* (2006.01)

(52) U.S. Cl.
CPC ..... *B41J 11/00222* (2021.01); *B41J 13/03* (2013.01)

(58) Field of Classification Search
CPC .... B41J 11/00222; B41J 13/03; B41J 11/002; B41J 11/0022; B41J 13/223
See application file for complete search history.

(56) References Cited

FOREIGN PATENT DOCUMENTS

WO WO 2013/165003 A1 11/2013

*Primary Examiner* — Bradley W Thies
(74) *Attorney, Agent, or Firm* — Squire Patton Boggs (US) LLP

(57) ABSTRACT

An image formation apparatus includes: a sheet feeder that conveys a paper fed from a sheet feed tray; a conveyance cylinder that includes a gripper that grips the paper, and receives the paper conveyed on the sheet feeder and conveys the paper to a position of a printing part in a state where the paper is gripped by the gripper; and a heater that is provided on an upstream side of the conveyance cylinder in a conveyance direction and heats the paper so as to satisfy a temperature condition of following Expression (1):

$$|T1-T2|/T1<0.15 \quad \text{Expression (1)}$$

where T1 is a temperature [° C.] of a paper end of the paper at the position of the printing part, and T2 is a temperature [° C.] of the paper end of the paper when the paper is transferred from the sheet feeder to the conveyance cylinder.

12 Claims, 6 Drawing Sheets

IMAGE FORMATION APPARATUS AND HEATING METHOD FOR IMAGE FORMATION APPARATUS

The entire disclosure of Japanese patent Application No. 2020-201126, filed on Dec. 3, 2020, is incorporated herein by reference in its entirety.

BACKGROUND

Technological Field

The present disclosure relates to an image formation apparatus and a heating method for the image formation apparatus.

Description of the Related art

Conventionally, there has been known an inkjet image formation apparatus (hereinafter, it is abbreviated as an "image formation apparatus") that ejects ink from a plurality of nozzles provided in an inkjet head toward a paper conveyed by a conveyance device, to thereby form (record) an image on the paper (see, for example, WO 2013/165003).

In this type of image formation apparatus, after papers stacked on a sheet feed tray are separated one by one by a feeder board, the papers are transferred from the feeder board to a conveyance cylinder (for example, as illustrated in FIG. 2 to be described later, a rotary conveyance body including a first conveyance cylinder and a second conveyance cylinder), and an image is formed on the papers by an inkjet head in the process of conveying the papers by the conveyance cylinder.

A paper is typically transferred from the feeder board to the conveyance cylinder in such a manner that the paper conveyed to a front end position of the feeder board is gripped by a claw part provided on the conveyance cylinder and the paper is drawn from the feeder board to the conveyance cylinder.

FIG. 1 is a view illustrating an example of the claw part provided on the conveyance cylinder. Note that the claw part illustrated in FIG. 1 includes a plurality of grip claws provided at predetermined intervals along a paper width direction of the paper (that is, a direction orthogonal to a conveyance direction of the paper), and has a structure to grip the front end of the paper by the plurality of grip claws.

Incidentally, in this type of image formation apparatus, in order to enhance the wettability of ink on a paper when ink is discharged, a preheating mechanism is introduced in which the temperature of an outer peripheral surface of the conveyance cylinder is raised in advance to a predetermined temperature (for example, about 60° C.), and the temperature of the paper is raised to the predetermined temperature in the process of conveying the paper by the conveyance cylinder.

However, as a result of intensive studies by the inventors of the present application, it has become clear that due to this preheating mechanism, a large temperature difference occurs between the temperature of the paper being conveyed on the feeder board and the temperature of the outer peripheral surface of the conveyance cylinder, and due to this, when the paper P is transferred from a feeder board 12 to conveyance cylinders 21 and 22 (immediately after transfer and during conveyance thereafter), thermal expansion occurs in an area gripped by the claw part at the front end of the paper (typically, an area between respective grip claws of the claw part), and wrinkles occur. The wrinkles generated at the front end of the paper spread to a printing area of the paper, and induce landing deviation of the ink when the paper is conveyed to the position of the printing part (here, the position of the inkjet head). That is, such wrinkles cause deterioration in quality of an image formed on a paper. Further, when such wrinkles occur, a front end portion of the paper rises, and thus, due to this, the paper may collide with an ink head of the image formation apparatus, which may cause damage to the ink head.

Note that such wrinkles occur due to thermal expansion of the paper, and thus are likely to occur particularly in synthetic paper having a large thermal expansion coefficient in general.

SUMMARY

The present disclosure has been made in view of the above problems, and an object of the present disclosure is to provide an image formation apparatus and a heating method for the image formation apparatus capable of suppressing deterioration in image quality due to occurrence of wrinkles on paper during paper conveyance.

To achieve the abovementioned object, according to an aspect of the present invention, an image formation apparatus reflecting one aspect of the present invention comprises: a sheet feeder that conveys a paper fed from a sheet feed tray; a conveyance cylinder that includes a gripper that grips the paper, and receives the paper conveyed on the sheet feeder and conveys the paper to a position of a printing part in a state where the paper is gripped by the gripper; and a heater that is provided on an upstream side of the conveyance cylinder in a conveyance direction and heats the paper so as to satisfy a temperature condition of following Expression (1):

$$|T1-T2|/T1<0.15 \qquad \text{Expression (1)}$$

where T1 is a temperature [° C.] of a paper end of the paper at the position of the printing part, and T2 is a temperature [° C.] of the paper end of the paper when the paper is transferred from the sheet feeder to the conveyance cylinder.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
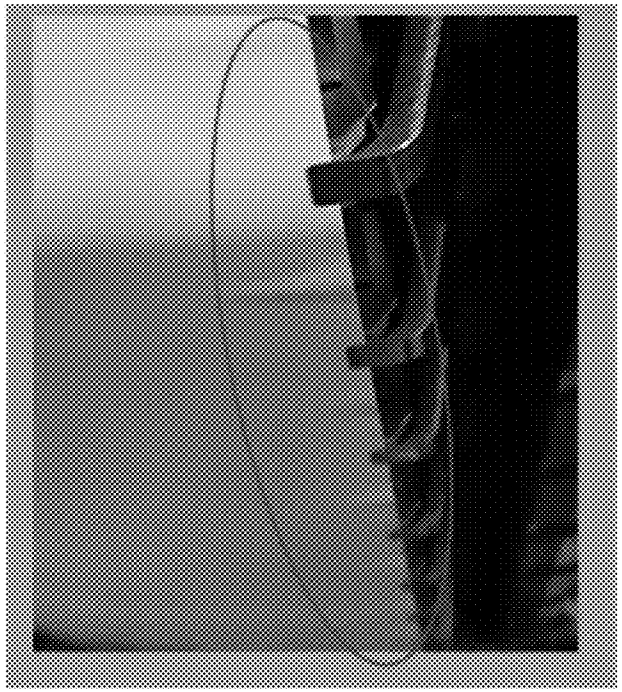
FIG. 1 is a view illustrating an example of a claw part provided on a conveyance cylinder.

Hereinafter, one or more preferred embodiments of the present disclosure will be described in detail with reference to the accompanying drawings. However, the scope of the invention is not limited to the disclosed embodiments. Note that in the present specification and the drawings, components having substantially the same function are denoted by the same reference numerals, and redundant description is omitted.

[Schematic Configuration of Inkjet Image Formation Apparatus]

Hereinafter, a schematic configuration of an image formation apparatus according to an embodiment of the present invention will be described with reference to FIGS. 2 to 4.

Figure 2:
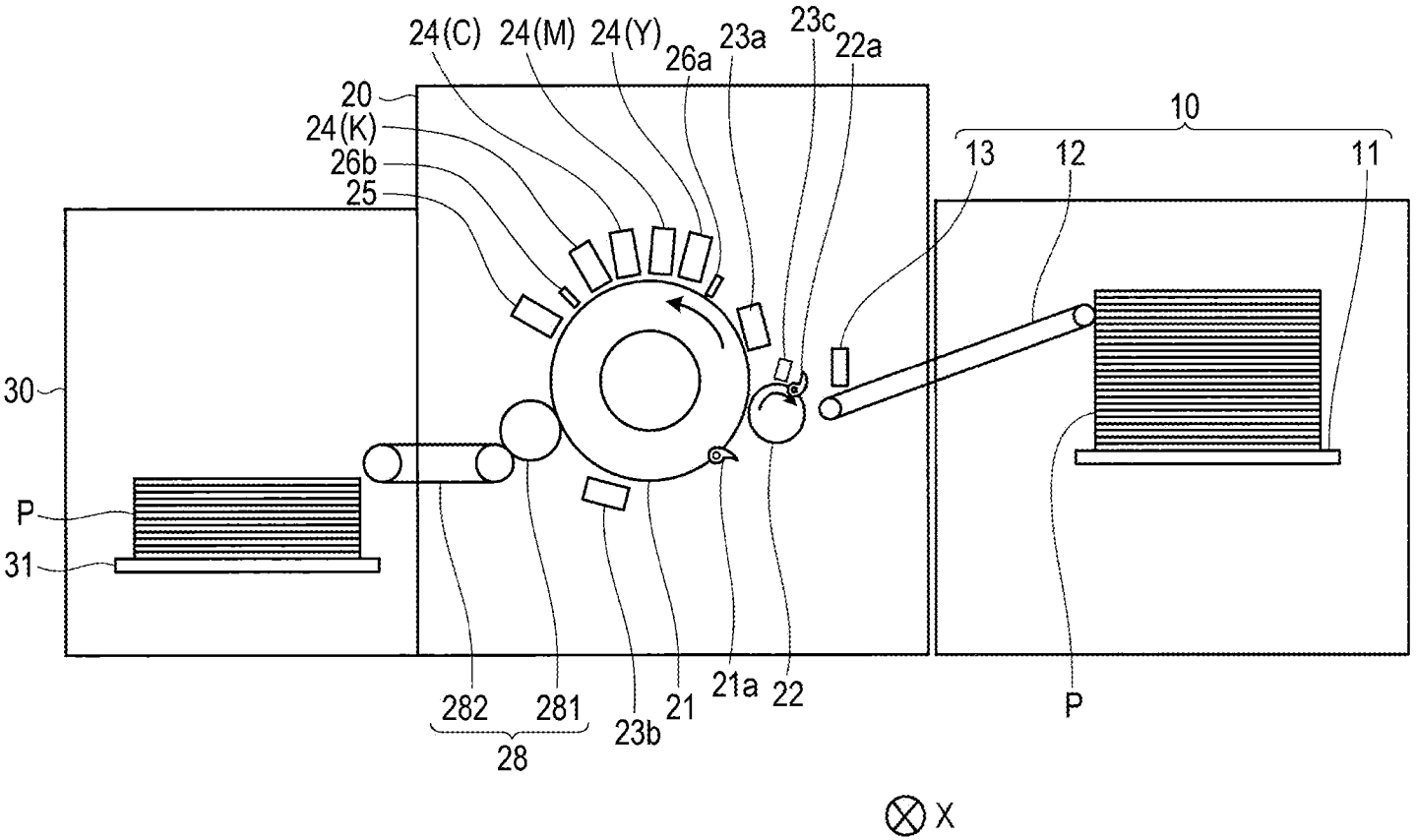
FIG. 2 is a diagram illustrating an overall configuration of an image formation apparatus according to an embodiment.

FIG. 2 is a diagram schematically illustrating an overall configuration of an image formation apparatus 1 according to the present embodiment.

Figure 4:
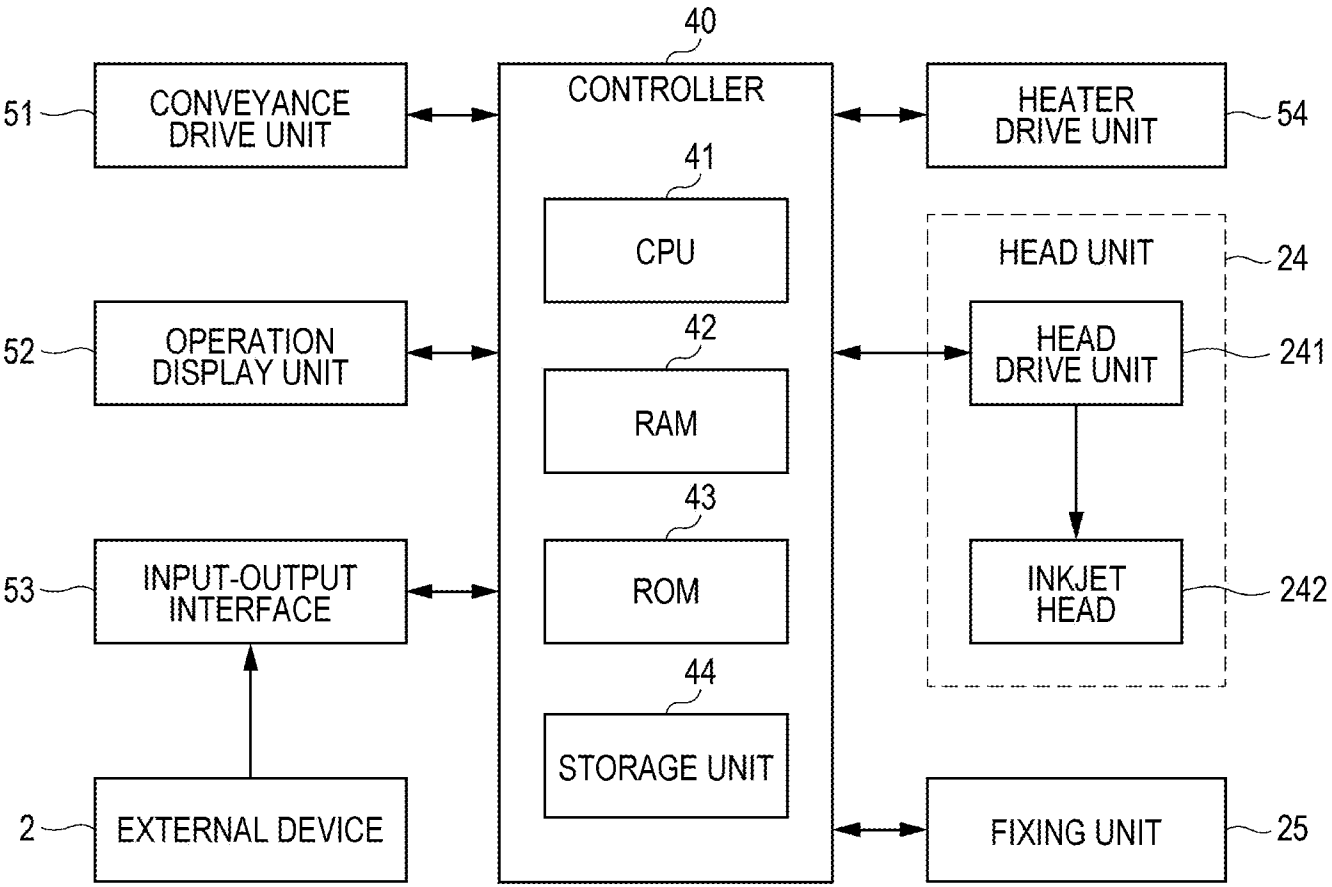
FIG. 4 is a block diagram illustrating a configuration of a control system of the image formation apparatus according to the embodiment.

The image formation apparatus 1 includes a sheet feeder unit 10, an image former 20, a sheet ejection unit 30, and a controller 40 (see FIG. 4).

Under the control of the controller 40, the image formation apparatus 1 conveys a paper P stored in the sheet feeder unit 10 to the image former 20, forms an image on the paper P in the image former 20, and conveys the paper P on which the image is formed to the sheet ejection unit 30. As the paper P on which an image is to be formed by the image formation apparatus 1, any type of paper such as plain paper (paper produced using wood pulp as a main raw material) and synthetic paper (paper produced using synthetic resin as a main raw material) can be used.

The sheet feeder unit 10 includes a sheet feed tray 11 that stores the paper P, a feeder board 12 that conveys the paper P from the sheet feed tray 11 to the image former 20 (second conveyance cylinder 22), and a first heater 13 that heats a front end of the paper P before the paper P is transferred from the feeder board 12 to the second conveyance cylinder 22 of the image former 20. Note that a detailed configuration of the sheet feeder unit 10 will be described later with reference to FIGS. 5 and 6.

The image former 20 includes a first conveyance cylinder 21, a second conveyance cylinder 22, a second heater 23*a*, a third heater 23*b*, a fourth heater 23*c*, a head unit 24, a fixing unit 25, a first temperature sensor 26*a*, a second temperature sensor 26*b*, and a delivery unit 28.

The first conveyance cylinder 21 has a cylindrical shape, holds the paper P on its own outer peripheral surface (that is, a conveyance surface), and conveys the paper P (also referred to as a printing cylinder) to a position where an image is formed by the head unit 24 (corresponding to a "printing part" of the present invention). The first conveyance cylinder 21 includes a claw part 21*a* and a suction part (not illustrated) for holding the paper P on an outer peripheral surface thereof. The end of the paper P is pressed by the claw part 21*a*, and the paper P is sucked to the outer peripheral surface by the suction part to be held on the outer peripheral surface. The first conveyance cylinder 21 is connected to a motor (not illustrated) and rotates by an angle proportional to a rotation amount of the motor. Then, the first conveyance cylinder 21 rotates about a rotation shaft (cylindrical shaft) extending in an X direction (a direction perpendicular to the paper surface of FIG. 2) to circulate, to thereby convey the paper P along a rotation direction of the first conveyance cylinder 21.

The second conveyance cylinder 22 has a cylindrical shape, holds the paper P on its own outer peripheral surface (that is, the conveyance surface), and conveys the paper P (also referred to as a preheat cylinder). The second conveyance cylinder 22 is interposed between the feeder board 12 and the first conveyance cylinder 21, receives the paper P from the feeder board 12 at a position where the second conveyance cylinder 22 faces the feeder board 12, conveys the paper P to a position where the second conveyance cylinder 22 faces the first conveyance cylinder 21, and then passes the paper P to the first conveyance cylinder 21. The second conveyance cylinder 22 is configured such that, for example, when the first conveyance cylinder 21 rotates by one holding area (for example, 120°) of the paper P in conjunction with the rotation operation of the first conveyance cylinder 21 by a gear mechanism (not illustrated), the second conveyance cylinder 22 makes one rotation in an opposite direction.

Similarly to the first conveyance cylinder 21, for example, the second conveyance cylinder 22 includes a claw part 22*a* and a suction part (not illustrated) for holding the paper P on the outer peripheral surface thereof. The claw part 22*a* (corresponding to a "gripper" of the present invention) is disposed on the outer peripheral surface (that is, the conveyance surface) of the second conveyance cylinder 22, and grips the end (here, the front end) of the paper P conveyed to the front end position of the feeder board 12 to draw the paper P from the feeder board 12 onto the outer peripheral surface of the second conveyance cylinder 22. Then, the end of the paper P is pressed by the claw part 22*a*, and the paper P is sucked to the outer peripheral surface by the suction part to be held on the outer peripheral surface. Note that, for example, as illustrated in FIG. 1, the claw part 22*a* includes a plurality of grip claws provided at predetermined intervals along the paper width direction of the paper P.

The second conveyance cylinder 22 is provided with, for example, a cam mechanism (not illustrated) that opens and closes the claw part 22*a* and controls the receiving operation and transfer operation of the paper P at the second conveyance cylinder 22. When the claw part 22*a* reaches a position close to and facing the feeder board 12, the cam mechanism changes the claw part 22*a* from an open state to a closed state, and causes the claw part 22*a* to perform an operation of receiving the paper P. Further, when the claw part 22*a* reaches a position close to and facing the claw part 21*a* of the first conveyance cylinder 21, the cam mechanism changes the claw part 22*a* from the closed state to the open state, and causes the claw part 22*a* to perform an operation of transferring the paper P from the claw part 22*a* to the claw part 21*a* of the first conveyance cylinder 21.

Note that a passing claw that supports transfer of the paper P from the feeder board 12 to the second conveyance cylinder 22 may be provided adjacent to a position where the second conveyance cylinder 22 and the feeder board 12 face each other.

Note that in the present embodiment, as an example of a conveyance cylinder that receives the paper P conveyed on the feeder board 12 and conveys the paper P to the print execution position, an aspect including the first conveyance cylinder 21 and the second conveyance cylinder 22 is illustrated. However, in the present invention, the configuration of the conveyance cylinder may be any configuration, and the conveyance cylinder may include only the first conveyance cylinder 21. Hereinafter, when the first conveyance cylinder 21 and the second conveyance cylinder 22 are not distinguished from each other, they are also simply referred to as a "conveyance cylinder 21, 22".

The second heater 23*a* is a heater that heats the paper P conveyed by the first conveyance cylinder 21 so that the paper P has a temperature within a predetermined temperature range. The second heater 23*a* is constituted by, for example, an infrared heater, and heats the paper P conveyed while being held on the outer peripheral surface of the first conveyance cylinder 21 from a front surface side thereof The second heater 23*a* is provided to face the outer peripheral surface of the first conveyance cylinder 21 at a position on a downstream side in the conveyance direction of a position facing the second conveyance cylinder 22 and on an upstream side in the conveyance direction of a position facing the head unit 24 in the outer peripheral surface of the first conveyance cylinder 21.

The third heater 23*b* is a heater that heats the outer peripheral surface (that is, the conveyance surface) of the first conveyance cylinder 21. Similarly to the second heater 23*a*, for example, the third heater 23*b* is constituted by an infrared heater, and irradiates the outer peripheral surface of the first conveyance cylinder 21 with infrared rays to heat the outer peripheral surface of the first conveyance cylinder 21. The third heater 23*b* is provided to face the outer peripheral surface of the first conveyance cylinder 21 at a position on a downstream side in the conveyance direction of the position facing the delivery unit 28 and on an upstream side in the conveyance direction of the position facing the second conveyance cylinder 22 in the outer peripheral surface of the first conveyance cylinder 21.

In the image formation apparatus 1 according to the present embodiment, the second heater 23*a* directly heats the paper P before the ink discharged from the head unit 24 lands, and the third heater 23*b* raises the temperature of a paper conveyance area (that is, an area of conveyance from paper receiving position to a print execution position) of the outer peripheral surface of the first conveyance cylinder 21 to a predetermined temperature, to thereby maintain the paper P before and after the ink lands at an appropriate temperature.

Note that the operations of the second heater 23*a* and the third heater 23*b* are controlled by the controller 40 (see FIG. 4). The second heater 23*a* is controlled, for example, so that the temperature of the paper P is within a predetermined temperature range (for example, 45° C. to 60° C.) at the time of ink landing, and the third heater 23*b* is controlled, for example, so that the temperature of the outer peripheral surface of the first conveyance cylinder 21 is within a predetermined temperature range (for example, 50° C. to 65° C.). For example, the controller 40 controls the second heater 23*a* and the third heater 23*b* based on temperature information indicated by the first temperature sensor 26*a* and the second temperature sensor 26*b*.

The fourth heater 23*c* is a heater that heats the outer peripheral surface (that is, the conveyance surface) of the second conveyance cylinder 22. The fourth heater 23*c* is constituted by, for example, an infrared heater, and irradiates the outer peripheral surface of the second conveyance cylinder 22 with infrared rays to heat the outer peripheral surface of the second conveyance cylinder 22. The second conveyance cylinder 22 preliminarily heats the paper P in the process of conveying the paper P while holding the paper P on its own outer peripheral surface.

The operation of the fourth heater 23*c* is controlled by the controller 40 (see FIG. 4), and the fourth heater 23*c* is controlled so that the temperature of the outer peripheral surface of the second conveyance cylinder 22 falls within a predetermined temperature range (for example, 50° C. to 65° C.).

Note that from the viewpoint of suppressing occurrence of wrinkles in the paper P due to thermal expansion of the paper P when the paper P is transferred from the second conveyance cylinder 22 to the first conveyance cylinder 21, the temperature difference between the temperature of the outer peripheral surface of the second conveyance cylinder 22 and the temperature of the outer peripheral surface of the first conveyance cylinder 21 is preferably small, and is typically set to substantially the same temperature. However, from the viewpoint of gradually increasing the temperature of the paper P, the temperature of the outer peripheral surface of the first conveyance cylinder 21 may be set to be higher than the temperature of the outer peripheral surface of the second conveyance cylinder 22. Conversely, from the viewpoint of increasing the temperature of the paper P from an early stage, the temperature of the outer peripheral surface of the second conveyance cylinder 22 may be set to be higher than the temperature of the outer peripheral surface of the first conveyance cylinder 21.

The head unit 24 (hereinafter, it is also referred to as a printing part 24) is disposed facing a predetermined position of the outer peripheral surface of the first conveyance cylinder 21 in a state where its own ink ejection surface and the outer peripheral surface of the first conveyance cylinder 21 are separated by a predetermined distance. Then, the head unit 24 ejects ink onto the paper P held on the outer peripheral surface of the first conveyance cylinder 21 to form an image at an appropriate timing according to the rotation of the first conveyance cylinder 21 holding the paper P.

In the image formation apparatus 1 according to the present embodiment, four head units 24 respectively corresponding to inks of four colors of yellow (Y), magenta (M), cyan (C), and black (K) are arranged at predetermined intervals in the order of Y, M, C, and K colors from the upstream side in the conveyance direction of the paper P.

Figure 3:
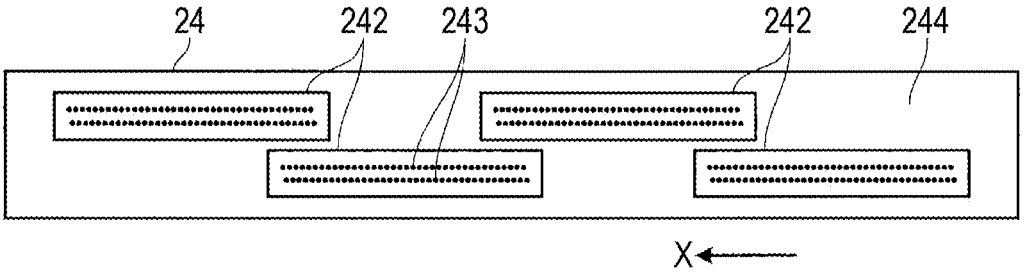
FIG. 3 is a schematic diagram illustrating a configuration of a head unit according to the embodiment.

FIG. 3 is a schematic diagram illustrating a configuration of the head unit 24 according to the present embodiment. Here, a surface of the head unit 24 facing the outer peripheral surface of the first conveyance cylinder 21 is illustrated.

The head unit 24 includes four inkjet heads 242 attached to an attachment member 244. Each of the inkjet heads 242 is provided with a plurality of image formation elements (recording elements) each including a pressure chamber that stores ink, a piezoelectric element provided on a wall surface of the pressure chamber, and a nozzle 243. In this image formation element, when a drive signal for operating the piezoelectric element to deform is input, the pressure chamber is deformed by the deformation of the piezoelectric element, the pressure in the pressure chamber changes, and ink is discharged from a nozzle communicating with the pressure chamber.

The four inkjet heads 242 are arranged in a staggered pattern such that arrangement ranges of nozzle rows in the X direction are connected without any discontinuity. The arrangement ranges of the nozzles 243 included in the head unit 24 in the X direction cover the width in the X direction of an area where an image is formed in the paper P conveyed by the first conveyance cylinder 21, and the position of the head unit 24 is fixed with respect to the rotation shaft of the first conveyance cylinder 21 when the image is formed. That is, the head unit 24 includes a line head capable of ejecting ink over an image formable width in the X direction with respect to the paper P.

The inkjet head 242 includes an ink heating unit (not illustrated) that heats the ink stored in the inkjet head 242, and ejects the heated ink in a sol state. When this sol-state ink is discharged onto the paper P, ink droplets land on the paper P and then are naturally cooled, so that the ink quickly turns into a gel state and solidifies on the paper P.

The fixing unit 25 has a light emitting unit disposed over the width of the first conveyance cylinder 21 in the X direction, and irradiates the paper P placed on the first conveyance cylinder 21 with energy rays such as ultraviolet rays from the light emitting unit to cure and fix the ink (gel ink) discharged on the paper P. The light emitting unit of the fixing unit 25 is arranged to face the outer peripheral surface of the first conveyance cylinder 21 between the arrangement position of the head unit 24 and the arrangement position of a transfer cylinder 281 of the delivery unit 28 in the conveyance direction.

The first temperature sensor 26*a* detects the temperature of the paper conveyance area of the outer peripheral surface of the first conveyance cylinder 21. The first temperature sensor 26*a* is disposed to face the outer peripheral surface of the first conveyance cylinder 21 at a position on a downstream side in the conveyance direction of the second heater 23*a* and on an upstream side in the conveyance direction of the head unit 24. As the first temperature sensor 26*a,* for example, a non-contact type temperature sensor such as a thermopile is used.

The second temperature sensor 26*b* detects the temperature of the paper P after the ink is applied by the head unit 24. The second temperature sensor 26*b* is disposed to face the outer peripheral surface of the first conveyance cylinder 21 at a position on a downstream side in the conveyance direction of the head unit 24 and on an upstream side in the conveyance direction of the fixing unit 25. As the second temperature sensor 26*b,* for example, a non-contact type temperature sensor such as a thermopile is used.

The delivery unit 28 includes a cylindrical transfer cylinder 281 that transfers the paper P from the first conveyance cylinder 21 to the belt loop 282, and a belt loop 282 having a ring-shaped belt whose inside is supported by two rollers, and the paper P transferred from the first conveyance cylinder 21 onto the belt loop 282 by the transfer cylinder 281 is conveyed and sent to the sheet ejection unit 30 by the belt loop 282.

The sheet ejection unit 30 includes a plate-like sheet ejection tray 31 on which the paper P fed from the image former 20 by the delivery unit 28 is placed.

FIG. 4 is a block diagram illustrating a configuration of a control system of the image formation apparatus 1 according to the present embodiment.

The control system of the image formation apparatus 1 includes the controller 40, a head drive unit 241, the fixing unit 25, a conveyance drive unit 51, an operation display unit 52, an input-output interface 53, a heater drive unit 54, and the like.

The controller 40 is, for example, a microcomputer including a central processing unit (CPU) 41, a random access memory (RAM) 42, a read only memory (ROM) 43, and a storage unit 44.

The CPU 41 reads various control programs and setting data stored in the ROM 43, stores the programs in the RAM 42, and executes the programs to perform various arithmetic processing. Further, the CPU 41 integrally controls the entire operation of the image formation apparatus 1. The RAM 42 provides the CPU 41 with a working memory space and stores temporary data. The RAM 42 may include a nonvolatile memory. The ROM 43 stores various control programs executed by the CPU 41, setting data, and the like. Note that instead of the ROM 43, a rewritable nonvolatile memory such as an electrically erasable programmable read-only memory (EEPROM) or a flash memory may be used.

The storage unit 44 stores a print job (image forming command) input from an external device 2 via the input-output interface 53, image data related to the print job, and the like. Among these, the print job includes information (for example, the size and thickness of the paper P) related to the type of paper P on which an image is formed, in addition to information specifying image data related to an image to be formed. As the storage unit 44, for example, a hard disk drive (HDD) is used, and a dynamic random access memory (DRAM) or the like may be used in combination.

The conveyance drive unit 51 supplies a drive signal to the motor of the first conveyance cylinder 21 based on a control signal supplied from the controller 40 to rotate the first conveyance cylinder 21 at a predetermined speed and timing In addition, the conveyance drive unit 51 supplies a drive signal to motors for operating the feeder board 12, the second conveyance cylinder 22, and the delivery unit 28 based on a control signal supplied from the controller 40 to supply the paper P to the first conveyance cylinder 21 and discharge the paper P from the first conveyance cylinder 21.

The operation display unit 52 includes a display device such as a liquid crystal display or an organic EL display, and an input device such as an operation key or a touch panel disposed to overlap a screen of the display device. The operation display unit 52 displays various types of information on the display device, converts a user's input operation on the input device into an operation signal, and outputs the operation signal to the controller 40.

The input-output interface 53 mediates transmission and reception of data between the external device 2 and the controller 40. The input-output interface 53 includes, for example, any one of or a combination of various serial interfaces and various parallel interfaces. Note that the external device 2 is, for example, a personal computer, and supplies a print job, image data, and the like to the controller 40 via the input-output interface 53.

The heater drive unit 54 is a drive circuit that drives the first heater 13, second heater 23*a,* third heater 23*b,* and fourth heater 23*c.* The heater drive unit 54 is capable of independently controlling operation of each of the first heater 13, the second heater 23*a,* the third heater 23*b,* and the fourth heater 23*c* based on a control signal supplied from the controller 40.

The head drive unit 241 supplies a drive signal for operating the piezoelectric element to deform according to the image data to the image formation element of the inkjet head 242 at an appropriate timing to cause the nozzles 243 of the inkjet head 242 to eject ink of an amount corresponding to the pixel value of the image data.

[Detailed Configuration of Sheet Feeder Unit 10]

Figure 5:
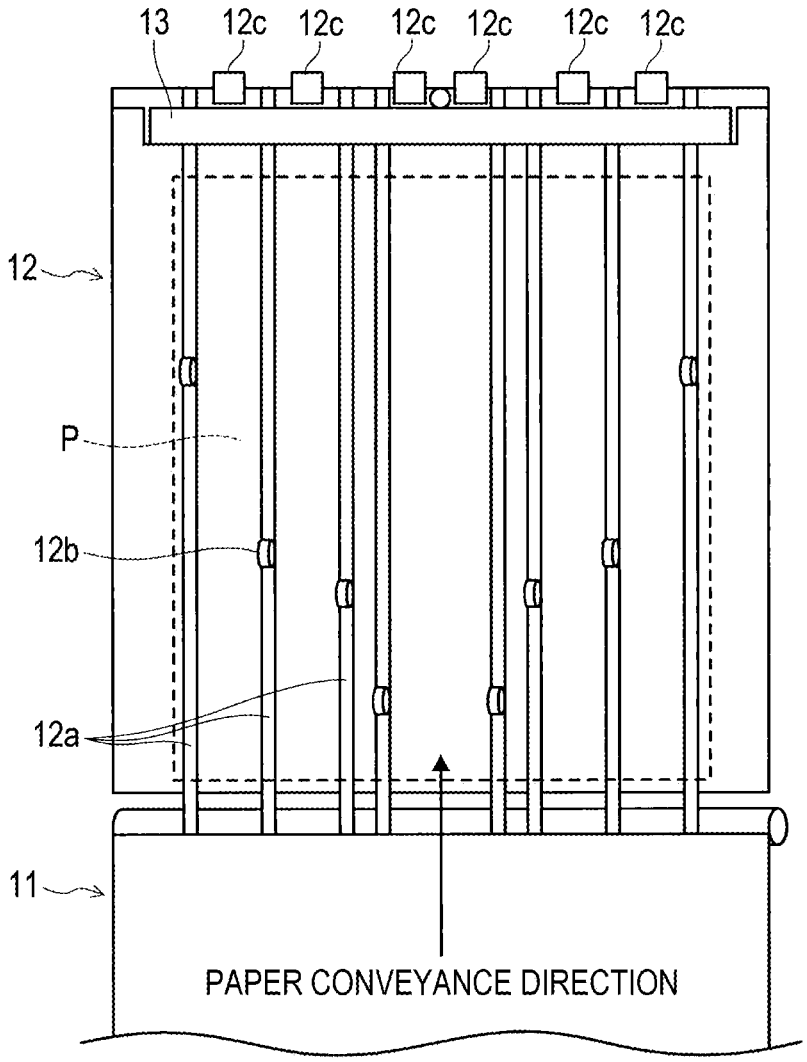
FIG. 5 is a plan view illustrating a configuration of a sheet feeder unit according to the embodiment.
Figure 6:
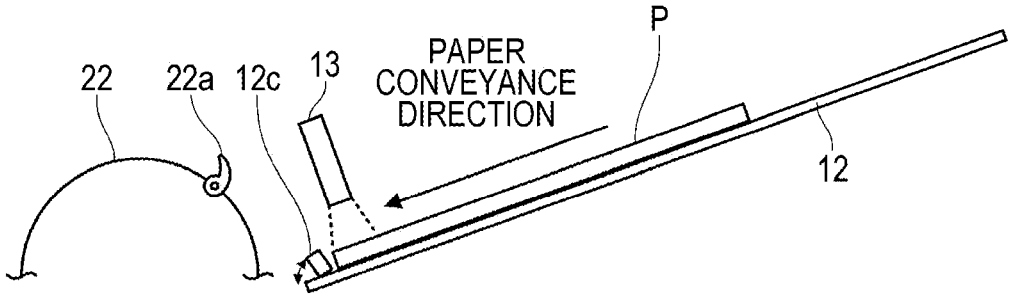
FIG. 6 is a side view illustrating a configuration of a sheet feeder unit according to the embodiment.

FIG. 5 is a plan view illustrating a configuration of the sheet feeder unit 10 according to the present embodiment, and FIG. 6 is a side view illustrating a configuration of the sheet feeder unit 10 according to the present embodiment.

The feeder board 12 (corresponding to a "sheet feeder" of the present invention) is continuously installed on the sheet feed tray 11, and the paper P stacked on the sheet feed tray 11 is separated into one or a plurality of papers by a sheet feed mechanism (for example, a mechanism that attracts and conveys the paper P on an uppermost stage of the bunch of papers stacked on the sheet feed tray 11) (not illustrated) and fed to the feeder board 12.

The feeder board 12 includes a sheet feed belt 12*a* that conveys the paper P fed from the sheet feed tray 11 to the feeder board 12 in the paper conveyance direction, a sheet pressing roller 12*b* that presses the paper P conveyed on the sheet feed belt 12*a* from above, a positioner 12*c* as a register that positions the paper P conveyed on the feeder board 12 at a position (that is, the front end position of the feeder board 12) where the paper P is transferred from the feeder board 12 to the second conveyance cylinder 22, and the like.

For example, the feeder board 12 is configured to convey the paper P fed from the sheet feed tray 11 by a stream feeder method. In the stream feeder method, the papers P are fed from the sheet feed tray 11 to the feeder board 12 in a state where a plurality of papers P is stacked while every one of the papers P is shifted by about 20 cm.

Here, the positioner 12*c* is, for example, a front stopper provided at the front end position of the feeder board 12. That is, the paper P fed from the sheet feed tray 11 to the feeder board 12 is conveyed by the sheet feed belt 12*a* and collides with the positioner 12*c*, so that the paper P is stopped and positioned at the front end position of the feeder board 12. Note that the surface of the positioner 12*c* on the side colliding with the paper P is an abutting surface extending in a direction orthogonal to the paper conveyance direction, and the paper P colliding with the positioner 12*c* is positioned such that the front end of the paper P is parallel to the direction orthogonal to the paper conveyance direction.

The paper P positioned by colliding with the positioner 12*c* is then gripped by the claw part 22*a* of the second conveyance cylinder 22 and transferred from the feeder board 12 to the second conveyance cylinder 22.

For example, the positioner 12*c* is configured to change between a tilted state and an upright state with respect to the conveying surface of the feeder board 12 as indicated by an arrow in FIG. 6 according to a rotational position of the second conveyance cylinder 22. More specifically, the positioner 12*c* is in the upright state when the claw part 22*a* of the second conveyance cylinder 22 has not reached the front end position of the feeder board 12, and is changed to the tilted state when the claw part 22*a* of the second conveyance cylinder 22 has reached the front end position of the feeder board 12. At this time, the front end of the paper P positioned at the front end position of the feeder board 12 is held by the claw part 22*a*, and the paper P is drawn from the feeder board 12 onto the outer peripheral surface of the second conveyance cylinder 22 and held on the outer peripheral surface of the second conveyance cylinder 22 as the second conveyance cylinder 22 rotates. Then, the paper P is conveyed along the rotation direction of the second conveyance cylinder 22 in a state of being held on the outer peripheral surface of the second conveyance cylinder 22.

Note that the state of the positioner 12*c* is changed by, for example, a cam mechanism (not illustrated) that operates in conjunction with the rotational operation of the second conveyance cylinder 22, or a drive motor (not illustrated) that operates the positioner 12*c* in accordance with the rotational position of the second conveyance cylinder 22.

The first heater 13 heats the paper P such that the temperature of the front end of the paper P falls within a predetermined temperature range before the paper P is transferred from the feeder board 12 to the conveyance cylinders 21 and 22. That is, the first heater 13 preheats the front end of the paper P before the front end of the paper P comes into contact with the outer peripheral surfaces of the conveyance cylinders 21 and 22 (here, the second conveyance cylinder 22), and suppresses occurrence of wrinkles at the front end of the paper P when the paper P is transferred from the feeder board 12 to the conveyance cylinders 21 and 22 (that is, immediately after transfer and during conveyance thereafter).

Typically, the wrinkles generated at the front end of the paper P rely on a phenomenon in which the temperature of the front end of the paper P rises to near the temperature of the outer peripheral surfaces of the conveyance cylinders 21 and 22 in a state where the front end of the paper P is pressed by the grip claw of the claw part 22*a*, and thereby the area between respective grip claws of the claw part 22*a* at the front end of the paper P is thermally expanded to be wrinkled. That is, the wrinkles at the front end of the paper P occur due to a rapid rise in temperature of the front end of the paper P when the paper P is transferred from the feeder board 12 to the conveyance cylinder 21 or 22, and the wrinkles further grows and spreads until the paper P is conveyed to the position of the printing part 24 by the conveyance cylinder 21 or 22.

Therefore, in the image formation apparatus 1 according to the present embodiment, by preheating the front end of the paper P using the first heater 13, when the paper P is transferred from the feeder board 12 to the conveyance cylinders 21 and 22 (that is, immediately after transfer and during conveyance thereafter), excessive thermal expansion of the area between the respective grip claws of the claw part 22*a* at the front end of the paper P is suppressed.

From such a viewpoint, for example, the first heater 13 heats the paper P so as to satisfy the temperature condition of the following Expression (1).

$$|T1-T2|/T1<0.15 \qquad \text{Expression (1)}$$

where T1 is a temperature [° C.] of the front end of the paper P at the position of the printing part 24, and T2 is a temperature [° C.] of the front end of the paper P when the paper P is transferred from the feeder board 12 to the conveyance cylinder 21 or 22. Thus, it is possible to suppress thermal expansion of the paper P that occurs when the paper P is transferred from the feeder board 12 to the conveyance cylinders 21 and 22 (that is, immediately after transfer and during conveyance thereafter), so that it is possible to suppress wrinkles that occur at the front end of the paper P. Note that the temperature of the front end of the paper P at the position of the printing part 24 may be defined by, for example, the sensor value of the first temperature sensor 26*a* (and/or the sensor value of the second temperature sensor 26*b*), or may be defined on the basis of the temperature of the outer peripheral surfaces of the conveyance cylinders 21 and 22.

At this time, more preferably, for example, the first heater 13 heats the paper P so as to satisfy the temperature condition of the following Expression (2).

$$(T1-T2)/T1<0 \qquad \text{Expression (2)}$$

where T1 is a temperature [° C.] of the front end of the paper P at the position of the printing part 24, and T2 is a temperature [° C.] of the front end of the paper P when the paper P is transferred from the feeder board 12 to the conveyance cylinder 21 or 22.

Further, more preferably, when the paper P is transferred from the feeder board 12 to the conveyance cylinder 21 or 22, the first heater 13 heats the front end of the paper P in advance so that the temperature of the front end of the paper P becomes equal to or higher than the temperature of the paper conveyance area of the outer peripheral surface of the conveyance cylinder 21 or 22.

Note that, here, it has been assumed that the temperature of the paper conveyance area of the outer peripheral surface of the first conveyance cylinder 21 and the temperature of the paper conveyance area of the outer peripheral surface of the second conveyance cylinder 22 are the same. However, in a case where the temperature of the paper conveyance area of the outer peripheral surface of the first conveyance cylinder 21 and the temperature of the paper conveyance area of the outer peripheral surface of the second conveyance cylinder 22 are different, the above-described temperature condition is typically set on the basis of the temperature of the paper conveyance area of the outer peripheral surface of the second conveyance cylinder 22.

For example, as illustrated in FIGS. 5 and 6, the first heater 13 is disposed at a position adjacent to the feeder board 12 and facing the positioner 12*c*, and is configured to heat the front end of the paper P when the paper P is positioned at the front end position of the feeder board 12. That is, the paper P is heated by the first heater 13 at the timing when positioned by the positioner 12*c*, and during the waiting time until the paper P is transferred from the feeder board 12 to the conveyance cylinder 21 or 22, the front end of the paper P is heated at least until the temperature difference between the temperature of the front end of the paper P and the temperature of the paper conveyance area of the outer peripheral surface of the conveyance cylinder 21 or 22 becomes substantially 7.5° C. or less. Note that, with such a configuration, the front end of the paper P can be efficiently heated in a short time, and a decrease in the temperature of the front end of the paper P from when the first heater 13 is subjected to the heat treatment to when the paper P is transferred to the conveyance cylinders 21 and 22 is also suppressed.

Note that in the stream feeder method, the feeder board 12 conveys a plurality of papers P in an overlapping state on the sheet feed tray 11 side, and separates the papers P one by one at the front end position (that is, the position where the paper P is transferred to the conveyance cylinders 21 and 22) side. Therefore, by disposing the first heater 13 at a position facing the positioner 12*c*, the first heater 13 is capable of separately heating the front end of each paper P.

As the first heater 13, for example, an air heating type heater that heats the paper P by blowing heated air is preferably used. The air heating type heater is useful in that local heating is possible and a high heating rate can be secured. Furthermore, since the temperature of the entire paper P is not unnecessarily raised, the occurrence of wrinkles can be suppressed with the minimum amount of heat. However, as the first heater 13, an infrared heater that heats the paper P by lamp irradiation, an electric resistance heater provided on the feeder board 12, or the like may be used.

Further, the first heater 13 preferably selectively heats the non-printing area adjacent to the front end of the paper P. This makes it possible to suppress the occurrence of temperature unevenness in the printing area of the paper P.

The operation of the first heater 13 is controlled by the controller 40, and is controlled to execute the heating operation, for example, at the timing when the paper P is conveyed on the feeder board 12.

However, the operation of the first heater 13 is preferably controlled to be in an operating state in a case where the type of the paper P is synthetic paper, and to be in a non-operating state in a case where the type of the paper P is non-synthetic paper (for example, plain paper). This is because the thermal expansion coefficient is small depending on the type of the paper P, and the wrinkle of the paper P does not cause a problem even when the paper P is transferred from the feeder board 12 to the conveyance cylinders 21 and 22 (that is, immediately after transfer and during conveyance thereafter). Specifically, since the wrinkle of the paper P is likely to occur to such an extent as to cause ink landing deviation particularly only when the type of the paper P is the synthetic paper, the first heater 13 may be set to the operating state only when the paper P as a print target is the synthetic paper from the viewpoint of suppressing energy consumption.

Figure 7:
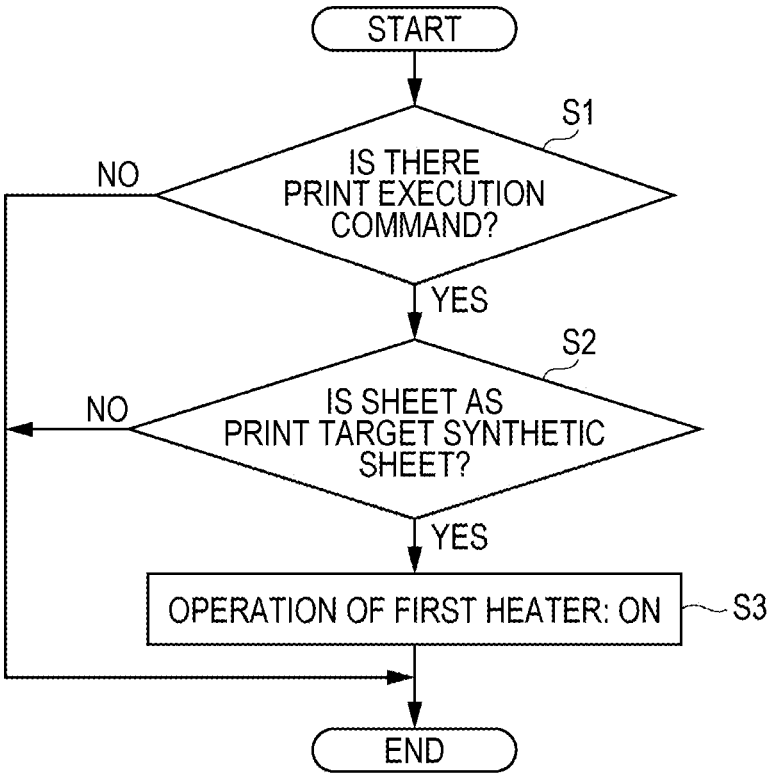
FIG. 7 is a flowchart illustrating an example of processing executed by a controller to control operation of a first heater in the image formation apparatus according to the embodiment.

FIG. 7 is a flowchart illustrating an example of processing executed by the controller 40 to control the operation of the first heater 13 in the image formation apparatus 1 according to the present embodiment. The flowchart illustrated in FIG. 7 is, for example, processing repeatedly executed by the controller 40 at predetermined intervals (for example, every 100 msec) according to a computer program.

In step S1, the controller 40 determines whether or not there is a print execution command Then, in a case where there is a print execution command (S1: YES), the controller 40 advances the processing to step S2, and in a case where there is no print execution command (S1: NO), the controller ends the processing of the flowchart of FIG. 7 without particularly performing the processing.

In step S2, the controller 40 determines whether or not the paper P as a print target is synthetic paper. Then, in a case where the paper P as a print target includes the synthetic paper (S2: YES), the controller 40 advances the processing to step S3, and in a case where the paper P as a print target is not the synthetic paper (S2: NO), the controller 40 ends the processing of the flowchart of FIG. 7 without performing any particular processing.

In step S3, the controller 40 turns on the operation of the first heater 13. Thus, the first heater 13 enters the operating state, and operates to perform a heat treatment on the front end of the paper P conveyed from the feeder board 12 and positioned by the positioner 12*c*.

By repeatedly executing such a series of processes, the controller 40 switches on and off of the operation of the first heater 13 according to the type of the paper P.

[Effects]

As described above, the image formation apparatus 1 according to the present embodiment includes:

a sheet feeder (for example, the feeder board 12) that conveys a paper fed from a sheet feed tray (for example, the sheet feed tray 11);

a conveyance cylinder (for example, the conveyance cylinders 21 and 22) that includes a gripper (for example, the claw part 22*a*) that grips the paper, and receives the paper conveyed by the sheet feeder and conveys the paper to a position of a printing part in a state where the paper is gripped by the gripper; and a heater (for example, first heater 13) that is provided on an upstream side of the conveyance cylinder in a conveyance direction and heats the paper so as to satisfy a temperature condition of the following Expression (3) before the paper is transferred from the sheet feeder to the conveyance cylinder.

$$|T1-T2|/T1<0.15 \qquad \text{Expression (3)}$$

where T1 is a temperature [° C.] of a paper end of the paper at the position of the printing part, and T2 is a temperature [° C.] of the paper end of the paper when the paper is transferred from the sheet feeder to the conveyance cylinder.

Therefore, with the image formation apparatus 1 according to the present embodiment, it is possible to suppress deterioration in image quality due to occurrence of wrinkles on a paper during paper conveyance.

Other Embodiments

The present invention is not limited to the above embodiment, and various modifications are conceivable.

For example, in the embodiment described above, as an example of the conveyance cylinder that receives the paper P conveyed on the feeder board 12 and conveys the paper P to the print execution position, an aspect including the first conveyance cylinder 21 and the second conveyance cylinder 22 has been described. However, in the present invention, the configuration of the conveyance cylinder may be any configuration, and the conveyance cylinder may include only the first conveyance cylinder 21. Note that in this case, the first heater 13 is configured to heat the paper P so as to satisfy a temperature condition similar to the above Expressions (1) and (2) on the basis of the temperature of the front end of the paper P when the paper P is transferred from the feeder board 12 to the first conveyance cylinder 21 and the temperature in the paper conveyance area of the outer peripheral surface of the first conveyance cylinder 21.

Further, in the above embodiment, as an example of the claw part 22*a*, an aspect in which the claw part includes a plurality of grip claws provided side by side along the paper width direction of the paper P has been described. However, in the present invention, the configuration of the claw part 22*a* may be any configuration, and for example, the claw part 22*a* may include a plurality of grip claws provided side by side along the conveyance direction of the paper P. Note that in a case where the claw part 22*a* includes a plurality of grip claws provided side by side along the conveyance direction of the paper P, the above-described wrinkle caused by thermal expansion mainly occurs at a lateral end of the paper P gripped by the plurality of grip claws. Therefore, in such a case, the first heater 13 is preferably configured to heat the lateral end of the paper P.

Although specific examples of the present invention have been described in detail above, these are merely examples and do not limit the scope of claims The technology described in the claims includes various modifications and changes of the specific examples exemplified above.

INDUSTRIAL APPLICABILITY

With the image formation apparatus of the present invention, it is possible to suppress deterioration in image quality due to occurrence of a wrinkle on a paper during paper conveyance.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image formation apparatus comprising:

a sheet feeder that conveys a paper fed from a sheet feed tray;

a conveyance cylinder that includes a gripper that grips the paper, and receives the paper conveyed on the sheet feeder and conveys the paper to a position of a printing part in a state where the paper is gripped by the gripper; and a heater that is provided on an upstream side of the conveyance cylinder in a conveyance direction and heats the paper so as to satisfy a temperature condition of following Expression (1):

$$|T1-T2|/T1<0.15 \quad \text{Expression (1)}$$

where T1 is a temperature [° C.] of a paper end of the paper at the position of the printing part, and T2 is a temperature [° C.] of the paper end of the paper when the paper is transferred from the sheet feeder to the conveyance cylinder.

2. The image formation apparatus according to claim 1, wherein the heater heats the paper in such a manner that a temperature of the paper end of the paper becomes equal to or higher than a temperature of a paper conveyance area of an outer peripheral surface of the conveyance cylinder before the paper is transferred from the sheet feeder to the conveyance cylinder.

3. The image formation apparatus according to claim 1, wherein the sheet feeder includes a positioner that positions the paper conveyed on the sheet feeder at a position where the paper is transferred from the sheet feeder to the conveyance cylinder, and the heater heats the paper end of the paper positioned by the positioner.

4. The image formation apparatus according to claim 1, wherein the heater heats a non-printing area of the paper.

5. The image formation apparatus according to claim 1, wherein the heater is an air heating type heater that heats the paper by blowing heated air.

6. The image formation apparatus according to claim 1, wherein the conveyance cylinder includes a first conveyance cylinder that conveys the paper to a print execution position, and a second conveyance cylinder that is located on an upstream side of the first conveyance cylinder in a conveyance direction and preheats the paper.

7. The image formation apparatus according to claim 1, wherein the gripper is a claw part that is provided on the outer peripheral surface of the conveyance cylinder and grips the paper end of the paper.

8. The image formation apparatus according to claim 7, wherein the claw part includes a plurality of grip claws provided side by side along a paper width direction of the paper or a plurality of grip claws provided side by side along a conveyance direction of the paper.

9. The image formation apparatus according to claim 1, wherein the sheet feeder conveys the paper fed from the sheet feed tray by a stream feeder method.

10. The image formation apparatus according to claim 1, further comprising a hardware processor that controls an operation of the heater, wherein the hardware processor brings the heater into an operating state in a case where the type of the paper is synthetic paper, and brings the heater into a non-operating state in a case where the type of the paper is non-synthetic paper.

11. The image formation apparatus according to claim 1 that is applied to an inkjet image formation apparatus.

12. A heating method for an image formation apparatus that includes:

a sheet feeder that conveys a paper fed from a sheet feed tray;

a conveyance cylinder that includes a gripper that grips the paper, and receives the paper conveyed on the sheet feeder and conveys the paper to a position of a printing part in a state where the paper is gripped by the gripper; and a heater that is provided on an upstream side of the conveyance cylinder in a conveyance direction, the heating method comprising heating, by the heater, the paper so as to satisfy a temperature condition of following Expression (2):

$$|T1-T2|/T1<0.15 \quad \text{Expression (2)}$$

where T1 is a temperature [° C.] of a paper end of the paper at the position of the printing part, and T2 is a temperature [° C.] of the paper end of the paper when the paper is transferred from the sheet feeder to the conveyance cylinder.

* * * * *